US011784441B2

(12) United States Patent
Huang et al.

(10) Patent No.: US 11,784,441 B2
(45) Date of Patent: Oct. 10, 2023

(54) CONDUCTIVE ASSEMBLY, TERMINAL ASSEMBLY STRUCTURE OF CONNECTOR AND CONNECTOR STRUCTURE

(71) Applicant: Industrial Technology Research Institute, Hsinchu (TW)

(72) Inventors: Tien-Fu Huang, Hsinchu County (TW); Li-Sen Chen, Kaohsiung (TW); Yi-Fu Chiu, Taichung (TW); I-Ting Hsieh, Yilan County (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 95 days.

(21) Appl. No.: 17/526,194

(22) Filed: Nov. 15, 2021

(65) Prior Publication Data

US 2022/0166173 A1 May 26, 2022

Related U.S. Application Data

(60) Provisional application No. 63/116,182, filed on Nov. 20, 2020.

(30) Foreign Application Priority Data

Sep. 14, 2021 (TW) ..... 110134285

(51) Int. Cl.
*H01R 13/6597* (2011.01)
*H01R 13/6585* (2011.01)
*H01R 13/6598* (2011.01)

(52) U.S. Cl.
CPC ..... *H01R 13/6597* (2013.01); *H01R 13/6585* (2013.01); *H01R 13/6598* (2013.01)

(58) Field of Classification Search
CPC ..... H01R 13/6597; H01R 13/6585; H01R 13/6598; H01R 13/6461; H01R 13/648; H01R 13/6581
See application file for complete search history.

(56) References Cited

U.S. PATENT DOCUMENTS 7,355,063 B2 4/2008 Yamaguchi et al.
7,371,117 B2 5/2008 Gailus
(Continued)

FOREIGN PATENT DOCUMENTS

CN 204947242 U 1/2016
CN 102906947 B 4/2016
(Continued)

OTHER PUBLICATIONS

TW OA issued on Jul. 5, 2022.

*Primary Examiner* — Truc T Nguyen
(74) *Attorney, Agent, or Firm* — WPAT, P.C

(57) ABSTRACT

A connector structure includes an insulated housing, at least one terminal assembly and at least one conductive assembly. The terminal assembly is disposed in the insulated housing. The conductive assembly is disposed at one side of the terminal assembly by crossing over the terminal assembly. The conductive assembly includes at least one metal piece and at least one polymer included conductive component. The polymer included conductive component is used to electrically connect the at least one metal pieces. The metal piece includes at least one spring finger contact, and the spring finger contact is electrically connected to the ground terminal in the terminal assembly. In additional, a terminal assembly structures of connector is also provided.

23 Claims, 8 Drawing Sheets

(56) References Cited

U.S. PATENT DOCUMENTS

| | | | | |
|---|---|---|---|---|
| 7,632,149 | B2 | 12/2009 | Bixler et al. | |
| 7,722,401 | B2 | 5/2010 | Kirk et al. | |
| 7,753,731 | B2 | 7/2010 | Cohen et al. | |
| 8,430,691 | B2 | 4/2013 | Davis | |
| 8,523,583 | B2 | 9/2013 | Ito | |
| 8,808,029 | B2 | 8/2014 | Castillo et al. | |
| 8,858,243 | B2 | 10/2014 | Luo et al. | |
| 8,864,506 | B2 | 10/2014 | Little et al. | |
| 9,455,533 | B1 * | 9/2016 | Evans | H01R 13/6581 |
| 9,531,130 | B1 * | 12/2016 | Phillips | H01R 13/6471 |
| 10,128,620 | B1 * | 11/2018 | Wu | H01R 13/405 |
| 10,348,040 | B2 | 7/2019 | Cartier, Jr. et al. | |
| 2016/0336691 | A1 * | 11/2016 | de Boer | H01R 13/6585 |
| 2017/0170606 | A1 * | 6/2017 | Phillips | H01R 13/6471 |
| 2018/0062323 | A1 * | 3/2018 | Kirk | H01R 13/6473 |
| 2019/0148887 | A1 | 5/2019 | Chen et al. | |
| 2021/0320449 | A1 | 10/2021 | Huang | |

FOREIGN PATENT DOCUMENTS

| | | | |
|---|---|---|---|
| CN | 107645105 | A | 1/2018 |
| TW | M516245 | | 1/2016 |
| TW | I556525 | | 11/2016 |
| TW | M546036 | U | 7/2017 |
| TW | M562506 | U | 6/2018 |
| TW | M592612 | U | 3/2020 |
| TW | 202032870 | A | 9/2020 |
| TW | 202032871 | | 9/2020 |
| TW | I717919 | B | 2/2021 |
| TW | I727801 | B | 5/2021 |
| TW | 202121773 | A | 6/2021 |

* cited by examiner

CONDUCTIVE ASSEMBLY, TERMINAL ASSEMBLY STRUCTURE OF CONNECTOR AND CONNECTOR STRUCTURE

CROSS REFERENCE TO RELATED APPLICATION

This application claims the benefits of U.S. provisional application Ser. No. 63/116,182, filed Nov. 20, 2020, and Taiwan application Serial No. 110134285, filed Sep. 14, 2021, the disclosures of which are incorporated by references herein in its entirety.

TECHNICAL FIELD

The present disclosure relates in general to a connector structure having a conductive assembly and a terminal assembly.

BACKGROUND

Signal transmission within an electronic device is mainly carried out through a plurality of electronic connectors. Generally speaking, a typical composition of a common electronic connector mainly includes an insulation housing and a plurality of metal terminals. With the development of technology, heavier transmission loads to the electronic device is inevitable. Thus, signal transmission frequency or rate thereto shall be increased accordingly.

Nevertheless, while in transmitting high-speed signals, a crosstalk phenomenon between metal terminals would become significant. Such a crosstalk phenomenon is mainly caused by capacitive coupling. As an arrangement of metal terminals is too dense or poorly shielded, the crosstalk would seriously affect quality of signal transmission.

Thus, the issue how to improve the existing connectors and to reduce the crosstalk so as to overcome the above-mentioned problems will be urgent to be solved in the art.

SUMMARY

An object of the present disclosure is to provide a connector structure having at least a conductive assembly and a terminal assembly, which can reduce the crosstalk phenomenon in high-speed signal transmission, and can thus improve the associated transmission bandwidth.

In one embodiment of this disclosure, a connector structure includes an insulated housing, at least one terminal assembly and at least one conductive assembly. The at least one terminal assembly is disposed inside the insulated housing, and each of the at least one terminal assembly includes an insulation body, a plurality of signal terminals and a plurality of ground terminals. Each of the plurality of signal terminals and each of the plurality of ground terminals are individually arranged and fixed at the insulation body. A number of the signal terminals out of the plurality of signal terminals is sandwiched by neighboring two of the plurality of ground terminals. The at least one conductive assembly is disposed at one end of the terminal assembly by crossing over the terminal assembly. Each of the at least one conductive assembly includes at least one metal piece and at least one polymer-included conductive component. The at least one polymer-included conductive component electrically connects the at least one metal piece for keeping a distance between the plurality of signal terminals and the at least one polymer-included conductive component. Each of the at least one metal piece includes at least one spring finger contact, and the spring finger contact is electrically connected with corresponding one of the plurality of ground terminals.

In another embodiment of this disclosure, a terminal assembly structure of connector includes a terminal assembly and at least one conductive assembly. The terminal assembly includes an insulation body, a plurality of signal terminals and a plurality of ground terminals. Each of the plurality of signal terminals and each of the plurality of ground terminals are individually arranged and fixed at the insulation body. A number of the signal terminals out of the plurality of signal terminals is sandwiched by neighboring two of the plurality of ground terminals. The at least one conductive assembly is disposed at one end of the terminal assembly by crossing over the terminal assembly. Each of the at least one conductive assembly includes at least one metal piece and at least one polymer-included conductive component. The at least one polymer-included conductive component electrically connects the at least one metal piece for keeping a distance between the plurality of signal terminals and the at least one polymer-included conductive component. Each of the at least one metal piece includes at least one spring finger contact, and the spring finger contact is electrically connected with corresponding one of the plurality of ground terminals.

In one further embodiment of this disclosure, a conductive assembly is applied to connect a terminal assembly of a connector. The terminal assembly includes an insulation body, a plurality of signal terminals and a plurality of ground terminals. Each of the plurality of signal terminals and each of the plurality of ground terminals are individually arranged and fixed at the insulation body, and a number of the signal terminals out of the plurality of signal terminals is sandwiched by neighboring two of the plurality of ground terminals. The conductive assembly includes a plurality of metal pieces and at least one polymer-included conductive component, electrically connected with the plurality of metal pieces for keeping a distance between the plurality of signal terminals and the at least one polymer-included conductive component. Each of the plurality of metal pieces includes at least one spring finger contact, and the spring finger contact is electrically connected with the closest one of the plurality of ground terminals.

As stated, in the conductive assembly, the terminal assembly structure of connector, and the connector structure provided in this disclosure, a plurality of metal pieces are introduced to connect electrically and individually all the ground terminals, and then the polymer-included conductive component is used to integrate all these metal pieces together, such that a broad equipotential ground region can be formed. With the metal pieces and the polymer-included conductive component to construct the composite conductive assembly for further forming the shielding structure to cover the terminal assembly, the crosstalk phenomenon can be inhibited, and the transmission bandwidth and rate can be substantially enhanced.

Further scope of applicability of the present application will become more apparent from the detailed description given hereinafter. However, it should be understood that the detailed description and specific examples, while indicating exemplary embodiments of the disclosure, are given by way of illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings which are given by way of illustration only, and thus are not limitative of the present disclosure and wherein.

DETAILED DESCRIPTION

Figure 1:
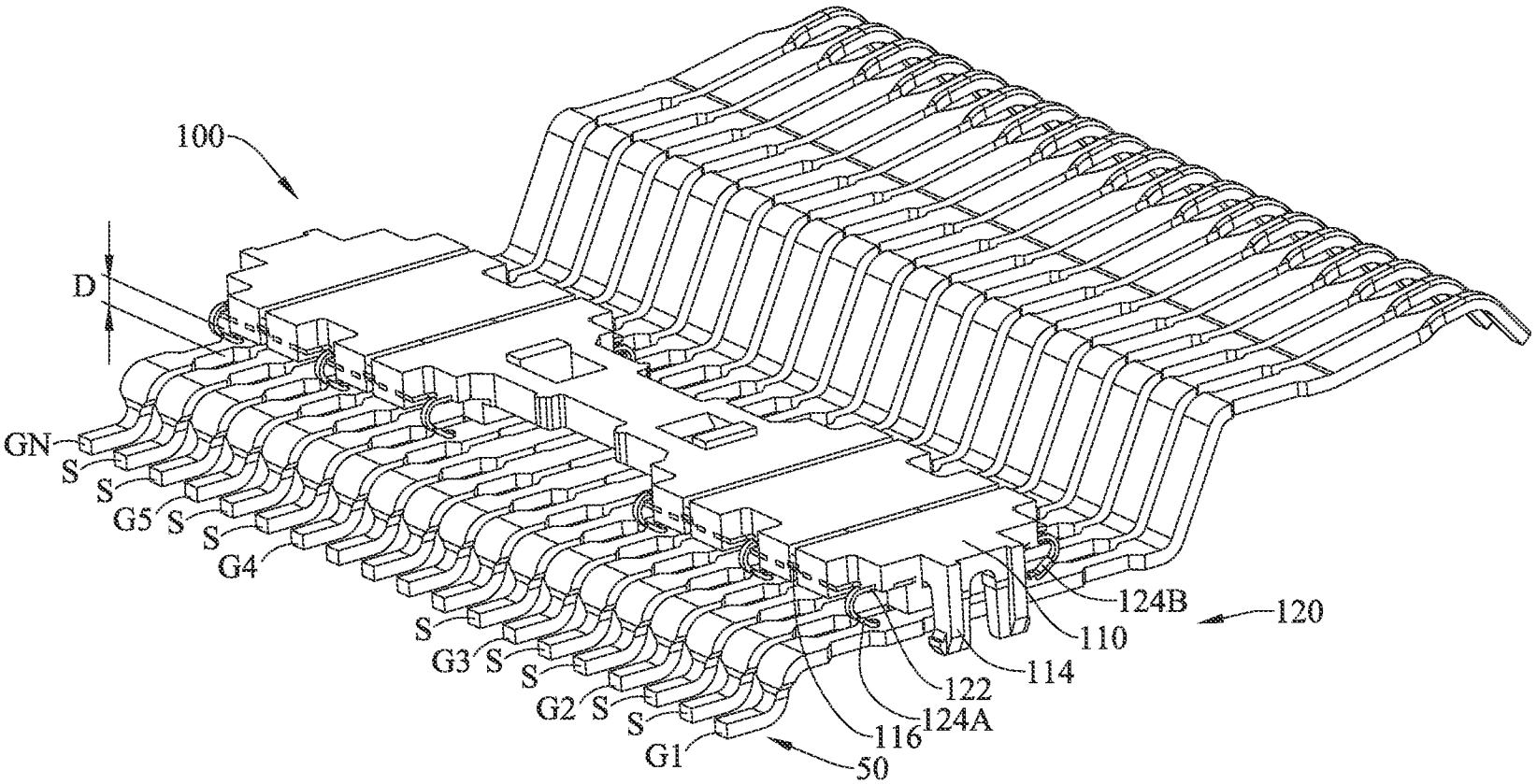
FIG. 1 is a schematic perspective view of an embodiment showing connection of a conductive assembly and a terminal assembly in accordance with this disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Referring to FIG. 1 through FIG. 4, a conductive assembly 100 of this embodiment is engaged with a terminal assembly 80 to form a terminal assembly structure of a connector. The conductive assembly 100 is applied as a shielding structure. The terminal assembly 80 includes an insulation body 70 and various terminals 50 including signal terminals, power terminals and ground terminals. By having FIG. 1 and FIG. 2 as an example, the terminal 50 includes a plurality of signal terminals S and a plurality of ground terminals G1, G2, G3, G4, G5, GN, arranged and fixed individually at the insulation body 70. In particular, part of each of the signal terminals S and the ground terminals G1, G2, G3, G4, G5, GN is disposed inside the insulation body 70, and two said signal terminals S are sandwiched between any two adjacent ground terminals of one group (G1, G2, G3) or another group (G4, G5, GN). The aforesaid terminal arrangement is a regular arrangement, but this disclosure is not limited thereto. In some other embodiments, the arrangement for the ground terminals and the signal terminals is simply determined per practical requirements.

Figure 2:
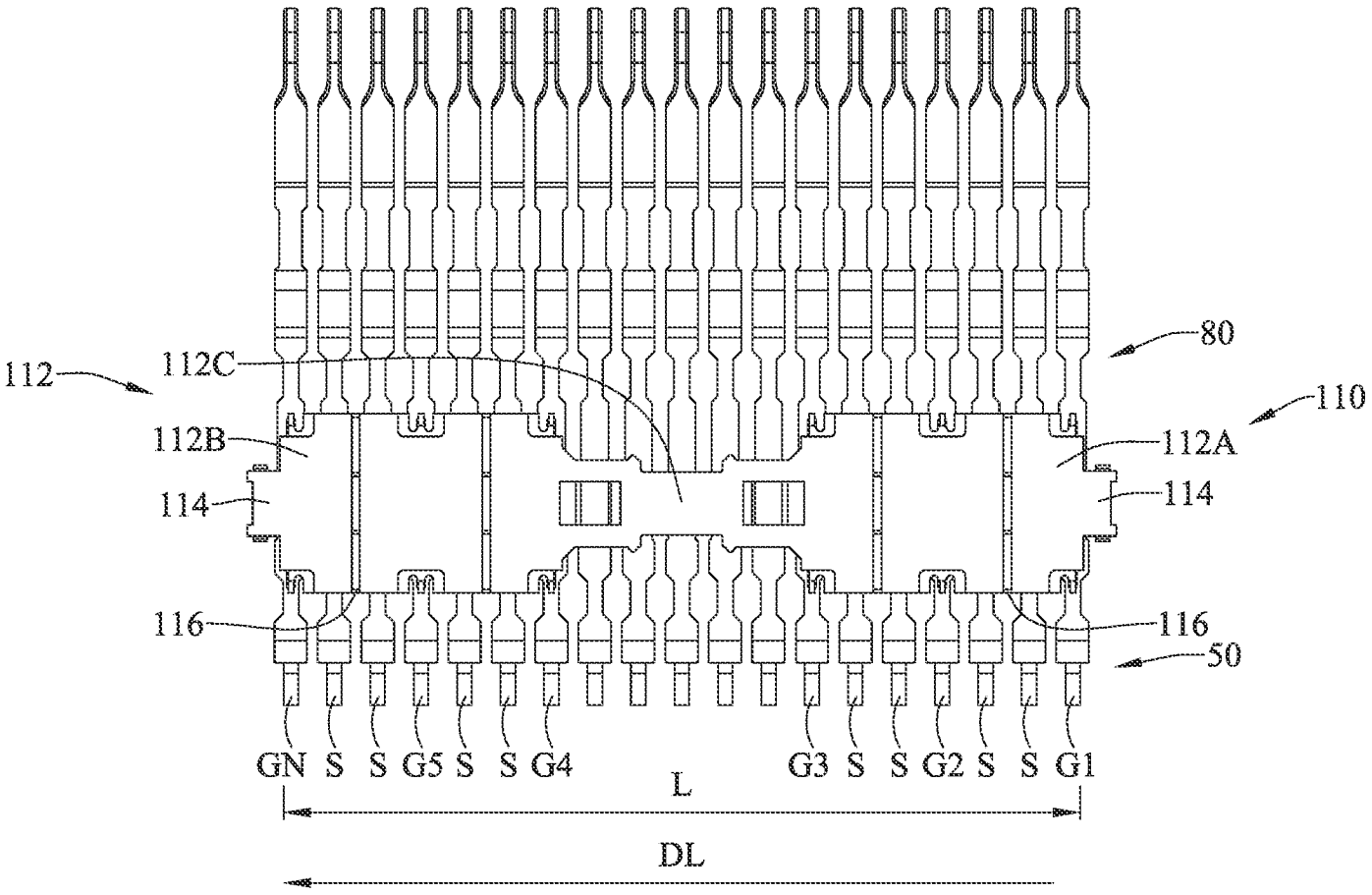
FIG. 2 is a schematic top view of FIG. 1.
Figure 3:
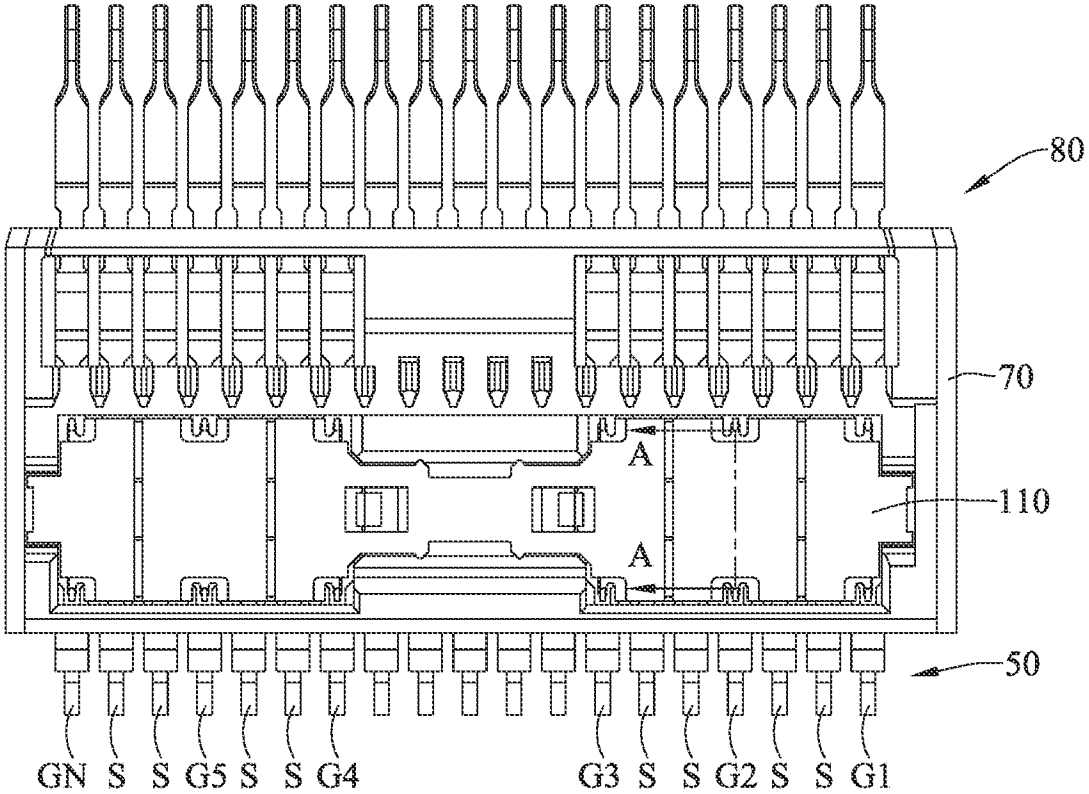
FIG. 3 is a schematic view of the terminal assembly of the connector in accordance with this disclosure.
Figure 4:
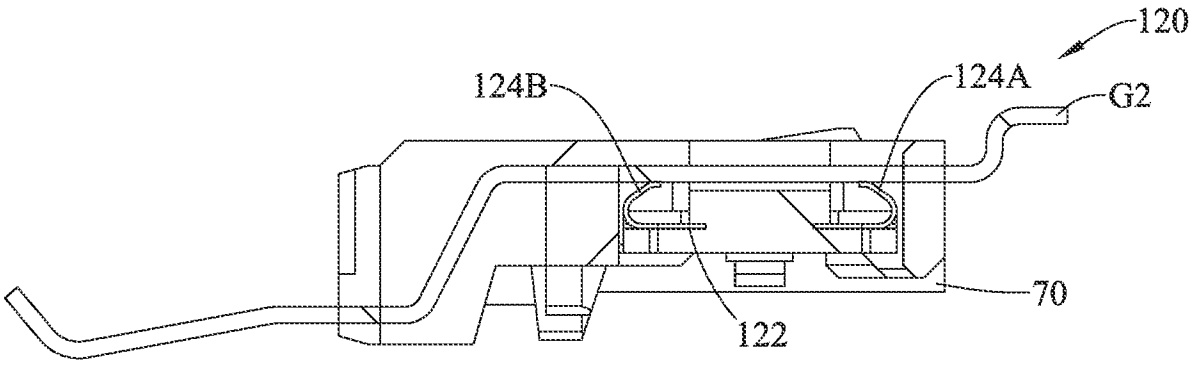
FIG. 4 is a schematic cross-sectional view of FIG. 3 along line A-A.

In this embodiment, the conductive assembly 100, disposed at one side of the terminal assembly 80 by crossing over the terminal assembly 80, includes a polymer-included conductive component 110 (also called as a conductive plastic) and a plurality of metal pieces 120, in which the polymer-included conductive component 110 is electrically connected with these metal pieces 120. Each of the metal pieces 120 includes a positioning segment 122 and at least one spring finger contact 124A or 124B connected with the positioning segment 122. The positioning segment 122, connected with the polymer-included conductive component 110, exposes the spring finger contacts 124A, 124B. The polymer-included conductive component 110 is formed to be a block with a substantial thickness, in which the conductive plastic is an insulation material at least doped with a conductive particle of a metal or graphite so as to present weak conductivity. The polymer-included conductive component 110 has the electrical conductance ranging from 0.1 to 100 seimens/m (S/m). The shape of the polymer-included conductive component 110 can be adjusted to comply with the shape of the terminal assembly. As shown in FIG. 2, the polymer-included conductive component 110 includes a conductive polymer body 112 and two connecting protrusions 114 extended from two opposite ends of the conductive polymer body 112. In this embodiment, each of the connecting protrusions 114 is formed as a buckling member extending horizontally firstly and then vertically downward from the corresponding end of the conductive polymer body 112. Different to the aforesaid conductive assembly 100 having a conductive plastic element and a plurality of metal pieces, a conductive assembly of another embodiment, not shown herein, may have a plurality of polymer-included conductive components and a plurality of metal pieces. Each of the metal pieces can be electrically connected to a corresponding one of the polymer-included conductive components, and the polymer-included conductive components are electrically connected to each other.

In this embodiment, the conductive polymer body 112 of the polymer-included conductive component 110 is spaced from the corresponding signal terminal S by a distance D, in which the distance D is ranged from 0.05 mm to 0.5 mm. The polymer-included conductive component 110 is spanned by a width L for covering at least the terminal assembly 80. As shown in FIG. 2, the ground terminals G1, G2, G3, G4, G5, GN are spaced from each other by specific distances, and each pair of the two neighboring ground terminals (G1, G2), (G2, G3), (G4, G5) and (G5, GN) is sandwiched with two signal terminals S. In an arrangement direction DL where the ground terminals G1, G2, G3, G4, G5, GN of the terminal assembly 80 are arranged therealong, the spanned width L of the polymer-included conductive component 110 is to cover at least the range from the ground terminal G1 to the ground terminal GN, such that the shielding effect provided by the conductive assembly 100 can cover each of the terminals 50. Of course, in some other embodiments not shown here, multiple polymer-included conductive components can be applied integrally to shield effectively the terminals 50. For example, referring to FIG. 2, the conductive polymer body 112 includes a first segment 112A, a second segment 112B and a third segment 112C, in which the third segment 112C is located between the first segment 112A and the second segment 112B. In addition, for connecting the adjacent segments 112A, 112B, 112C, shorting plates 116 are applied in between to make sure that all the connected segments 112A, 112B, 112C can have the same electric level (i.e., equipotentiality). Further, each of the metal pieces 120 includes a pair of spring finger contacts 124A, 124B to contact the same ground terminal G1, G2, G3, G4, G5 or GN. These metal pieces 120 are applied to all the segments 112A, 112B, 112C of the conductive polymer body 112, such that all the ground terminals G1, G2, G3, G4, G5, GN can have an identical electric level. In one exemplary example, the metal piece may include a single spring finger contact to contact the corresponding ground terminal for effectively and electrically connecting the metal piece to the ground terminal. In another exemplary example, the conductive assembly may have a plurality of spring finger contacts, and each of the spring finger contacts is assigned to contact specific ground terminal.

In addition, the aforesaid pair of the spring finger contacts 124A, 124B is used to electrically connect the closest ground terminal G1, G2, G3, G4, G5 or GN. Namely, the pair of the spring finger contacts 124A, 124B is electrically connected with one of the ground terminals G1, G2, G3, G4, G5, GN who has the shortest distance to the metal piece 120 having this pair of the spring finger contacts 124A, 124B.

According to this disclosure, equipotentiality of the ground terminals G1, G2, G3, G4, G5, GN is achieved by introducing the shorting plates 116 to connect the neighboring segments 112A, 112B, 112C of the conductive polymer body 112. Alternatively, the equipotentiality at the conductive polymer body 112 having the connected segments 112A, 112B, 112C can be also achieved by a capacitive coupling means, if the spacing between the neighboring segments 112A, 112B, 112C of the conductive polymer body 112 is sufficiently short.

Upon such an arrangement, a plurality of metal pieces 120 can be individually connected electrically with the respective ground terminals G1, G2, G3, G4, G5, GN, and then the polymer-included conductive component 110 is utilized to connect all the metal pieces 120, such that a broader common ground region can be formed for connecting electrically these neighboring and parallel ground terminals G1, G2, G3, G4, G5, GN. With all these metal pieces 120 to electrically integrate the ground terminals G1, G2, G3, G4, G5, GN, a better performance in resonance can be also obtained. In addition, with the polymer-included conductive component 110, a shielding effect can be provided, a better resonance-suppressing effect than the example having only the metal pieces 120 does can be obtained, and also the noise level can be substantially reduced. Thus, the composite conductive assembly consisted of the metal pieces 120 and the polymer-included conductive component 110 can form an effective shielding structure for covering the terminal assembly 80, such that the crosstalk concern in the prior art can be removed, and the transmission bandwidth and rate of the connector can be much improved.

Figure 5:
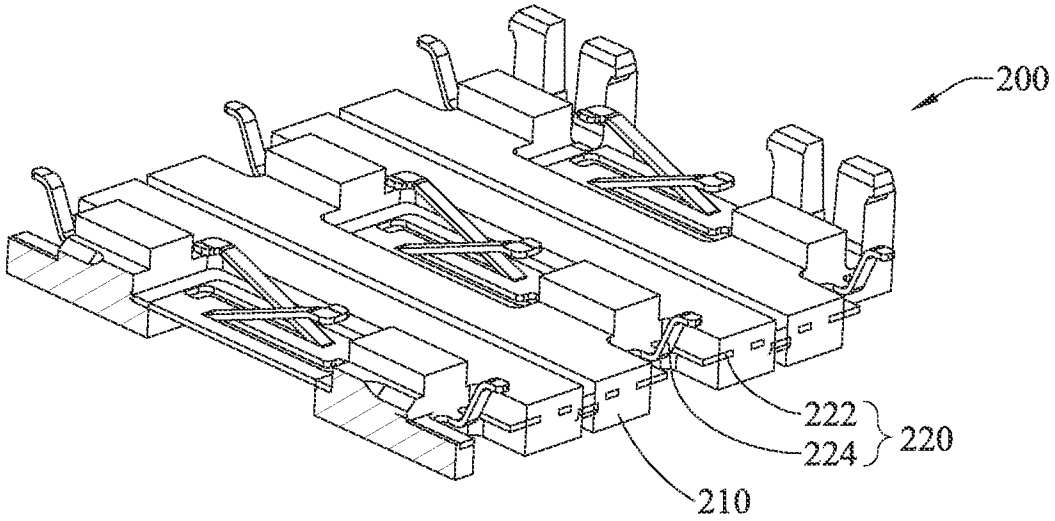
FIG. 5 is a schematic view of an embodiment of the conductive assembly in accordance with this disclosure.
Figure 6:
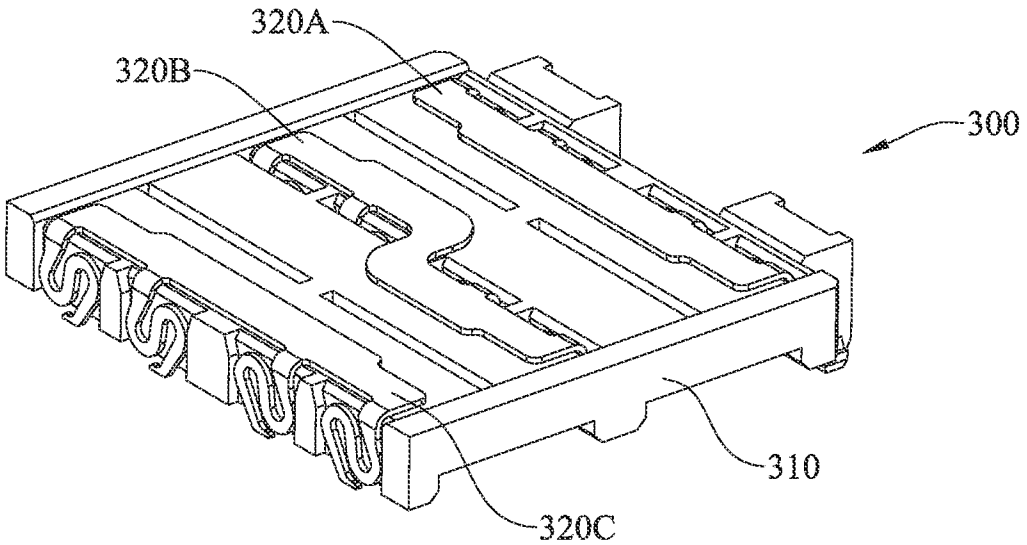
FIG. 6 is a schematic view of another embodiment of the conductive assembly in accordance with this disclosure.

According to this disclosure, the formulation of the conductive assembly is not limited to any aforesaid embodiment. Practically, any example that appropriate friction can exist between contact surfaces of the polymer-included conductive component and the metal pieces would be a candidate embodiment of this disclosure. Referring to FIG. 5, the conductive assembly 200 includes a polymer-included conductive component 210 and a plurality of metal pieces 220, and each of the metal pieces 220 includes a positioning segment 222 and at least one spring finger contact 224 extending from the positioning segment 222. These metal pieces 220 are directly embedded into the conductive plastics. In particular, the insert-molding is applied to dispose these metal pieces 220 into the polymer-included conductive component 210. These metal pieces 220 are fixed at predetermined positions of the polymer-included conductive component 210 due to the friction in between. In another embodiment, as shown in FIG. 6, the conductive assembly 300 includes a polymer-included conductive component 310 and a plurality of metal pieces including a first metal piece 320A, a second metal piece 320B and a third metal piece 320C. The first metal piece 320A, the second metal piece 320B and the third metal piece 320C may have different sizes or shapes, and may be disposed at different positions at the polymer-included conductive component 310. These metal pieces 320A, 320B are fixed at predetermined positions of the polymer-included conductive component 310 due to the friction in between.

As shown in FIG. 5 and FIG. 6, each of the metal pieces 220, the first metal piece 320A and the second metal piece 320B is made up by a sheet metal. The first metal piece 320A and the second metal piece 320B of FIG. 6 is formed by blanking the cutting edge of the metal sheet that contacts the corresponding the ground terminal. The metal piece 220 of FIG. 5 is formed from the non-cutting edge to contact the ground terminal. According to FIG. 5 and FIG. 6, if a general metal sheet forming method is utilized to form the metal piece 220, the first metal piece 320A or the second metal piece 320B, then such a method is acceptable no matter what the process is blanking or forming.

Though other processing methods for producing the metal piece are not directly implied by the drawings or specification of this disclosure, yet the resulted metal sheet product can be the metal piece of this disclosure if a conductive surface thereof can be formed to contact the ground terminal mechanically. In the art, these processing methods include at least a coating method for forming a conductive film onto an object, such as plating, sputtering, electroless plating, redox or laser direct structuring (LDS). Nevertheless, the aforesaid conductive plastics or polymer-included conductive component with weak conductivity is not the metal piece of this disclosure.

Figure 7:
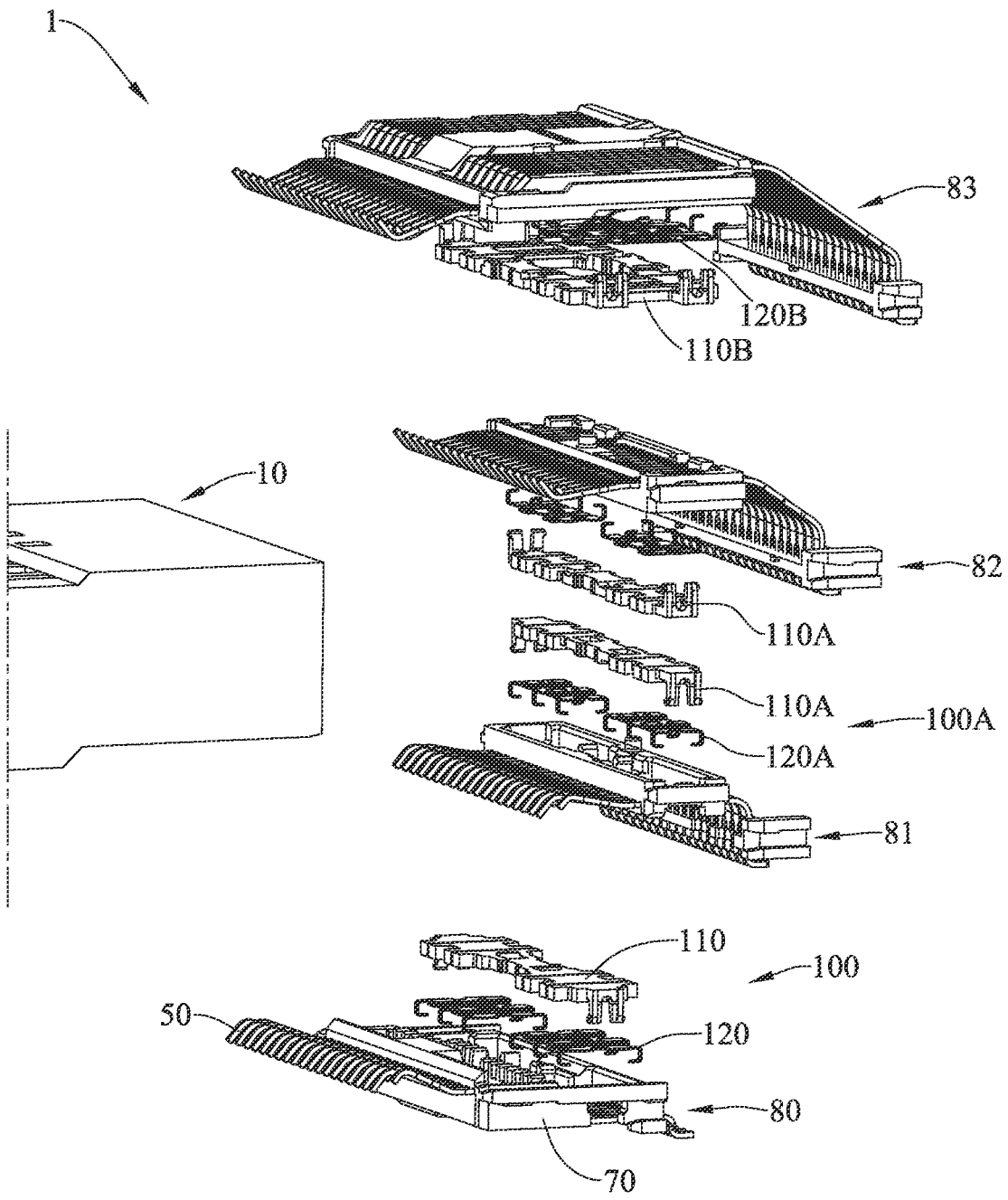
FIG. 7 is a schematic view of an embodiment of the connector structure in accordance with this disclosure.

FIG. 7 demonstrates schematically an embodiment of the connector structure in accordance with this disclosure. As shown, the connector structure 50 includes an insulated housing 10, a plurality of terminal assemblies (four 80, 81, 82, 83 shown in the figure) and a plurality of conductive assemblies (two 100, 100A shown in the figure). These terminal assemblies 80, 81, 82, 83 are overlapped to be disposed together into the insulated housing 10, and these terminal assemblies 80, 81, 82, 83 can be either identical or different structures, which is determined per requirements of the connector. The conductive assemblies 100, 100A include polymer-included conductive components 110, 110A, 110B and metal pieces 120, 120A, 120B. Sizes and shapes of these polymer-included conductive components 110, 110A, 110B and metal pieces 120, 120A, 120B can be determined according to the arrangements of the terminal assemblies 80, 81, 82, 83. In this embodiment, these four terminal assemblies 80, 81, 82, 83 are introduced to make the connector as a high-frequency connector. However, patterns and amount of the terminal assemblies used in the connector are determined per practical requirements. The aforesaid description is only to provide a concise explanation relevant for all possible embodiments in accordance with this disclosure.

Figure 8:
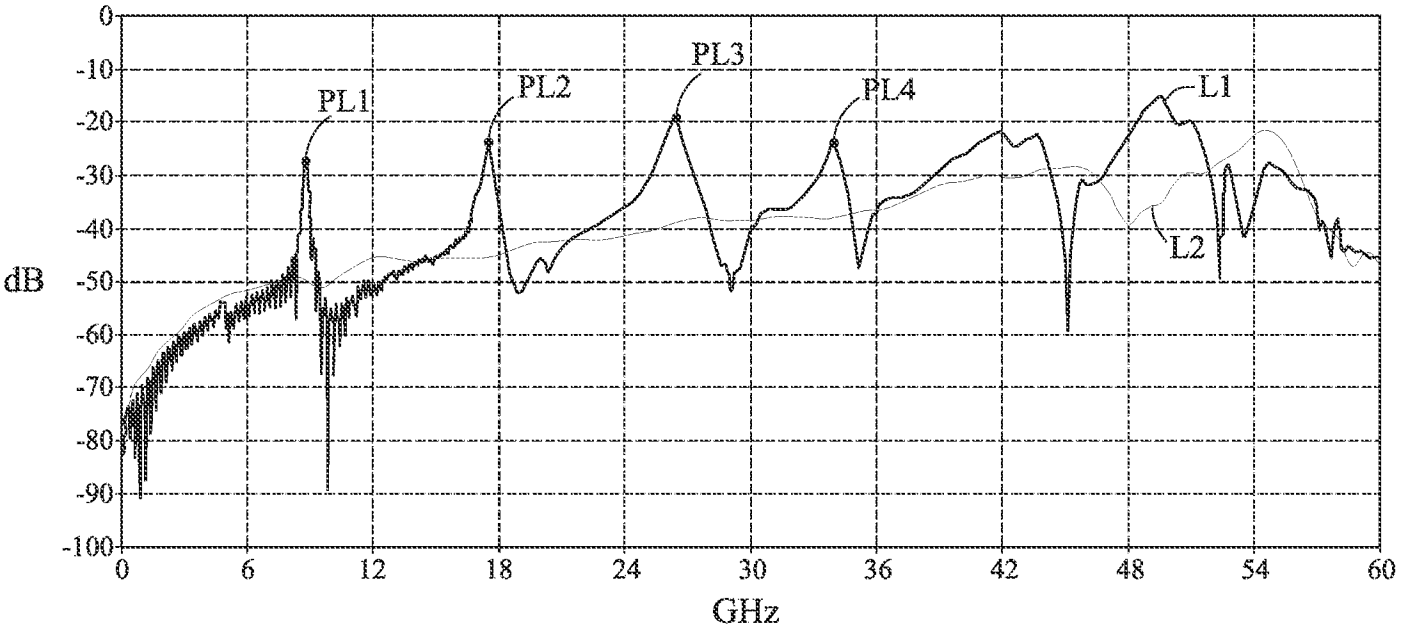
FIG. 8 is a plot showing comparisons of simulation gains among embodiments in accordance with this disclosure.

As shown in FIG. 8, results of insertion loss analysis upon simulation are schematically demonstrated. In the simulations, sample 1 is a conventional connector without any conductive assembly 100 of FIG. 1, and sample 2 is a connector equipped with the conductive assembly 100 of this disclosure. In FIG. 8, the unit of the horizontal axis is GHz, the unit of the vertical axis is dB, curve L1 is the simulation curve of insertion loss for sample 1, and curve L2 is the simulation curve of insertion loss for sample 2. As shown, to the frequencies high than 6 GHz, local maximum resonance is found at each of points PL1, PL2, PL3, PL4, corresponding to 9, 17, 26, 34 GHz, respectively. Each of these maximum resonance demonstrates a noise level higher than −30 dB; especially, −20 dB at point PL. Such a high noise level implies that a more significant signal decay to high-frequency signals transmitted by the corresponding terminal may have been induced by a stub effect. On the other hand, curve L2 demonstrates slow ascending variations (−52 dB~~36 dB) in the noise level between 6 GHz and 36 GHz. Accordingly, to the same frequency domain [6 GHz, 36 GHz], the stub effect does contribute positively to the embodiment of this disclosure in the integrity of signal transmission; i.e., less signal decays in high-frequency signal transmission. In other words, to the signal frequency higher than 6 GHz, the noise level is remarkably inhibited if the embodiment provided by this disclosure is applied; in particular, in curve L2, about −50 dB at around 9 GHz, about −45 dB at around 17 GHz, about −40 dB at around 26 GHz, and about −38 dB at around 34 GHz. Namely, in the aforesaid explanation upon FIG. 8, for the dB of curve L2 is greater than that of curve L1 at each of points PL1, PL2, PL3, PL4, it implies that less signal decays in high-frequency signal transmission are true for the signal transmission at the terminal indicated by curve L2 terminal. Thereupon, this disclosure can contribute to improve effectively the energy loss problem in high-frequency signal transmission, and thereby the corresponding transmission bandwidth and rate can be substantially enhanced.

In summary, in the conductive assembly, the terminal assembly structure of connector, and the connector structure provided in this disclosure, a plurality of metal pieces are introduced to connect electrically and individually all the ground terminals, and then the polymer-included conductive component is used to integrate all these metal pieces together, such that a broad equipotential ground region can be formed. With the metal pieces and the polymer-included conductive component to construct the composite conductive assembly for further forming the shielding structure to cover the terminal assembly, the crosstalk phenomenon can be inhibited, and the transmission bandwidth and rate can be substantially enhanced.

With respect to the above description then, it is to be realized that the optimum dimensional relationships for the parts of the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

What is claimed is:

1. A connector structure, comprising:

an insulated housing;

at least one terminal assembly, disposed inside the insulated housing, each of the at least one terminal assembly including an insulation body, a plurality of signal terminals and a plurality of ground terminals, each of the plurality of signal terminals and each of the plurality of ground terminals being individually arranged and fixed at the insulation body, a number of the signal terminals out of the plurality of signal terminals being sandwiched by neighboring two of the plurality of ground terminals; and at least one conductive assembly, disposed at one side of the at least one terminal assembly by crossing over the at least one terminal assembly, wherein each of the at least one conductive assembly includes at least one metal piece and at least one polymer-included conductive component, the at least one polymer-included conductive component electrically connects the at least one metal piece for keeping a distance between the plurality of signal terminals and the at least one polymer-included conductive component, each of the at least one metal piece includes at least one spring finger contact, and the spring finger contact is electrically connected with corresponding one of the plurality of ground terminals;

wherein the polymer-included conductive component has electrical conductance ranging from 0.1 seimens/m to 100 seimens/m.

2. The connector structure of claim 1, wherein a portion of each of the plurality of signal terminals and a portion of each of the plurality of ground terminals are embedded in the insulation body.

3. The connector structure of claim 1, wherein the conductive assembly has a plurality of the spring finger contacts for contacting the different ground terminals.

4. The connector structure of claim 1, wherein the distance is ranged from 0.05 mm to 0.5 mm.

5. The connector structure of claim 1, wherein, in a case of the conductive assembly has a plurality of the polymer-included conductive components and a plurality of the metal pieces, each of the plurality of the metal pieces is electrically connected with each of the plurality of the polymer-included conductive components, and all the plurality of the polymer-included conductive components are electrically connected.

6. The connector structure of claim 1, wherein, in an arrangement direction of the plurality of ground terminals, the polymer-included conductive component has a spanned width to cover at least the terminal assembly.

7. The connector structure of claim 1, wherein the metal piece is disposed in the corresponding polymer-included conductive component by an insert-molding method.

8. The connector structure of claim 1, wherein the metal piece is assembled to the corresponding polymer-included conductive component.

9. A terminal assembly structure of connector, comprising:

a terminal assembly, includes:

an insulation body;

a plurality of signal terminal and a plurality of ground terminal, each of the plurality of signal terminals and each of the plurality of ground terminals being individually arranged and fixed at the insulation body, a number of the signal terminals out of the plurality of signal terminals being sandwiched by neighboring two of the plurality of ground terminals; and at least one conductive assembly, disposed at one side of the terminal assembly by crossing over the terminal assembly, wherein each of the at least one conductive assembly includes at least one metal piece and at least one polymer-included conductive component, the at least one polymer-included conductive component electrically connects the at least one metal piece for keeping a distance between the plurality of signal terminals and the at least one polymer-included conductive component, each of the at least one metal piece includes at least one spring finger contact, and the spring finger contact is electrically connected with the closest one of the plurality of ground terminals;

wherein the polymer-included conductive component has electrical conductance ranging from 0.1 seimens/m to 100 seimens/m.

10. The terminal assembly structure of connector of claim 9, wherein a portion of each of the plurality of signal terminals and a portion of each of the plurality of ground terminals are embedded in the insulation body.

11. The terminal assembly structure of connector of claim 9, wherein the distance is ranged from 0.05 mm to 0.5 mm.

12. The terminal assembly structure of connector of claim 9, wherein the conductive assembly has a plurality of the spring finger contacts for contacting the different ground terminals.

13. The terminal assembly structure of connector of claim 9, wherein, when the conductive assembly has a plurality of the polymer-included conductive components and a plurality of the metal pieces, each of the plurality of the metal pieces is electrically connected with each of the plurality of the polymer-included conductive components, and all the plurality of the polymer-included conductive components are electrically connected.

14. The terminal assembly structure of connector of claim 9, wherein, in an arrangement direction of the plurality of ground terminals, the polymer-included conductive component has a spanned width to cover at least the terminal assembly.

15. The terminal assembly structure of connector of claim 9, wherein the metal piece is disposed in the corresponding polymer-included conductive component by an insert-molding method.

16. The terminal assembly structure of connector of claim 9, wherein the metal piece is assembled to the corresponding polymer-included conductive component.

17. A conductive assembly, applied to connect a terminal assembly of a connector, the terminal assembly including an insulation body, a plurality of signal terminals and a plurality of ground terminals, each of the plurality of signal terminals and each of the plurality of ground terminals being individually arranged and fixed at the insulation body, a number of the signal terminals out of the plurality of signal terminals being sandwiched by neighboring two of the plurality of ground terminals, the conductive assembly comprising:

a plurality of metal pieces; and at least one polymer-included conductive component, electrically connected with the plurality of metal pieces for keeping a distance between the plurality of signal terminals and the at least one polymer-included conductive component, each of the plurality of metal pieces including at least one spring finger contact, and the spring finger contact is electrically connected with the closest one of the plurality of ground terminals;

wherein the polymer-included conductive component has electrical conductance ranging from 0.1 seimens/m to 100 seimens/m.

18. The conductive assembly of claim 17, wherein the distance is ranged from 0.05 mm to 0.5 mm.

19. The conductive assembly of claim 17, wherein the conductive assembly has a plurality of the spring finger contacts for contacting the different ground terminals.

20. The conductive assembly of claim 17, wherein, when the conductive assembly has a plurality of the polymer-included conductive components and a plurality of the metal pieces, each of the plurality of the metal pieces is electrically connected with each of the plurality of the polymer-included conductive components, and all the plurality of the polymer-included conductive components are electrically connected.

21. The conductive assembly of claim 17, wherein, in an arrangement direction of the plurality of ground terminals, the polymer-included conductive component has a spanned width to cover at least the terminal assembly.

22. The conductive assembly of claim 17, wherein the metal piece is disposed in the corresponding polymer-included conductive component by an insert-molding method.

23. The conductive assembly of claim 17, wherein the metal piece is assembled to the corresponding polymer-included conductive component.

* * * * *